United States Patent [19]

Olson

[11] Patent Number: 4,902,209

[45] Date of Patent: Feb. 20, 1990

[54] SLIDING SEGMENT ROTARY FLUID POWER TRANSLATION DEVICE

[76] Inventor: Howard A. Olson, 18 Court St., Plum City, Wis. 54761

[21] Appl. No.: 164,479

[22] Filed: Mar. 4, 1988

[51] Int. Cl.[4] ..... F01C 1/344; F01C 1/356; F01C 11/00; F02B 53/04

[52] U.S. Cl. ..... 418/6; 418/13; 418/29; 418/30; 418/92; 418/137; 418/173; 418/174; 418/254; 123/240

[58] Field of Search ..... 418/173, 174, 6, 13, 418/29, 30, 136, 254, 91, 149, 92, 137; 123/240

[56] References Cited

U.S. PATENT DOCUMENTS

| | | | |
|---|---|---|---|
| 865,206 | 9/1907 | Ranick | 418/174 |
| 1,054,898 | 3/1913 | Bendixson | 418/6 |
| 1,607,383 | 11/1926 | Aurand | 418/6 |
| 1,766,872 | 6/1930 | Berglund | 418/136 X |
| 1,919,355 | 7/1933 | Bancroft | 418/13 X |
| 2,521,592 | 9/1950 | McManus | 418/6 |
| 2,552,860 | 5/1951 | Oliver | 418/29 |
| 3,194,220 | 7/1965 | Dowell et al. | 123/240 |
| 3,748,068 | 7/1973 | Keller | 418/137 |
| 3,764,241 | 10/1973 | Cartland et al. | 418/138 |
| 3,834,841 | 9/1974 | Falciai et al. | 418/29 X |
| 4,514,155 | 4/1985 | Ogawa | 418/149 |
| 4,558,998 | 12/1985 | Kiyoshige et al. | 418/30 X |
| 4,657,491 | 4/1987 | Frank | 418/136 |

*Primary Examiner*—John J. Vrablik

[57] ABSTRACT

A multiple or compound work cycle, eccentric rotor, fluid power translation device, featuring adjustable and reversible work output capability, essentially comprising: A symmetric rotor having a plurality of fixed radially extended vanes rotating closely between opposing co-axially adjustable confinement plates. An internal, eccentrically disposed annulus comprised of segmented concentric rings having co-axially protruding edges; said edges engaging circular, matching bearing grooves provided by said opposed confinement plates. The segments comprising each segmented ring being each penetrated by a rotor vane; two or more segments per vane thereby compelling co-rotation of said segments and locating said segments relative segments penetrated by adjacent rotor vanes. Individual chambers of the multiple work cycles, defined by adjacent rotor vanes, concentric fluid barriers, and the eccentric fluid barrier formed by the segmented annulus assembly, are caused to be expanded and reduced in volume by rotation in a progressive and cyclic manner. Working fluid flow volume and pressure or torque, speed, and direction of rotation can be variable from maximum to zero to maximum (reverse flow or direction of rotation), depending on whether used as a pump or motor, without valving, using relatively simple mechanical linkage, by changing the offset of the rotation axes between the normally eccentrically and concentrically rotating segments and rotor assemblies.

8 Claims, 5 Drawing Sheets

SLIDING SEGMENT ROTARY FLUID POWER TRANSLATION DEVICE

FIELD OF INVENTION

This invention relates to pumps, compressors, and fluid motors to include internal combustion engines and flow volume measurement devices.

DESCRIPTION OF PRIOR ART

It has been obvious for some time that an effective and efficient device which could directly translate mechanical torque and rotation to fluid flows and pressures, or vice versa, obviating reciprocating motion translation, would be a desirable goal. It is not surprising therefore that many such devices of various constructions have been proposed.

Several of the devices (See Pat. Nos. 865,206 to Ranck Sept. 3, 1907, 1,054,898 to Bendixson Mar. 4, 1913, and 3,764,241 to Cartland et al. Oct. 9, 1973) apparently similar to the present invention, consist of a rotor having a single vane, said vane penetrating an opening provided in an eccentrically disposed annular member having a unique rotation axis and bearing means. Rotation of the rotor vane causing said annular member to also rotate. This construction is difficult to dynamically balance, the annular member is subject to oblation and binding by localized internal pressures, and the working fluid ports must be quite small.

Another type employs multiple rotor vanes. (See Pat. No. 3,194,220 to Dowel et al. July 13, 1965) These vanes are hinged; provided with a central axis pivot which permits the vanes to be angularly relocated during rotation. The ring sections are subject to distortion and binding, being required to transmit torque loads between pivoting rotor vanes and those rotatably attached to the drive shaft. Working fluid ports must be small to prevent working fluid backflow as the rotor vanes traverse the port opening. The poppit valve, timing, and valve operation means impose most of the limitations normally associated with reciprocating devices thereby negating many of the advantages commonly associated with rotary devices.

OBJECTS AND ADVANTAGES

Accordingly I claim the following as my objects and advantages of the present invention: to provide a reliable, efficient, and effective mechanism for translating fluid pressure to torque and continuous rotation or vice versa at minimal cost by maintaining a basic construction essentially involving circles and plane surfaces, to provide a device having multiple or compound work cycles whereby said work cycles can be paralleled, staged, or perform various discrete functions, and to provide a device which can substantially combine the attributes commonly associated with accelerating or dynamic device types and those attributed to positive displacement devices.

In addition I claim the following objects and advantages: to provide a device capable of adjustable, regulated, working fluid flow volume, pressure, and reversible flow regardless of rotation, or adjustable torque and reversible rotation regardless of working fluid flow direction, and to provide a device which can be quickly and easily, disassembled for maintainence or cleaning, and reassembled and adjusted by relatively untrained personel.

DRAWING FIGURES

SLIDING SEGMENT ADJUSTABLE PUMP OR FLUID MOTOR—DESCRIPTION

Figure 1:
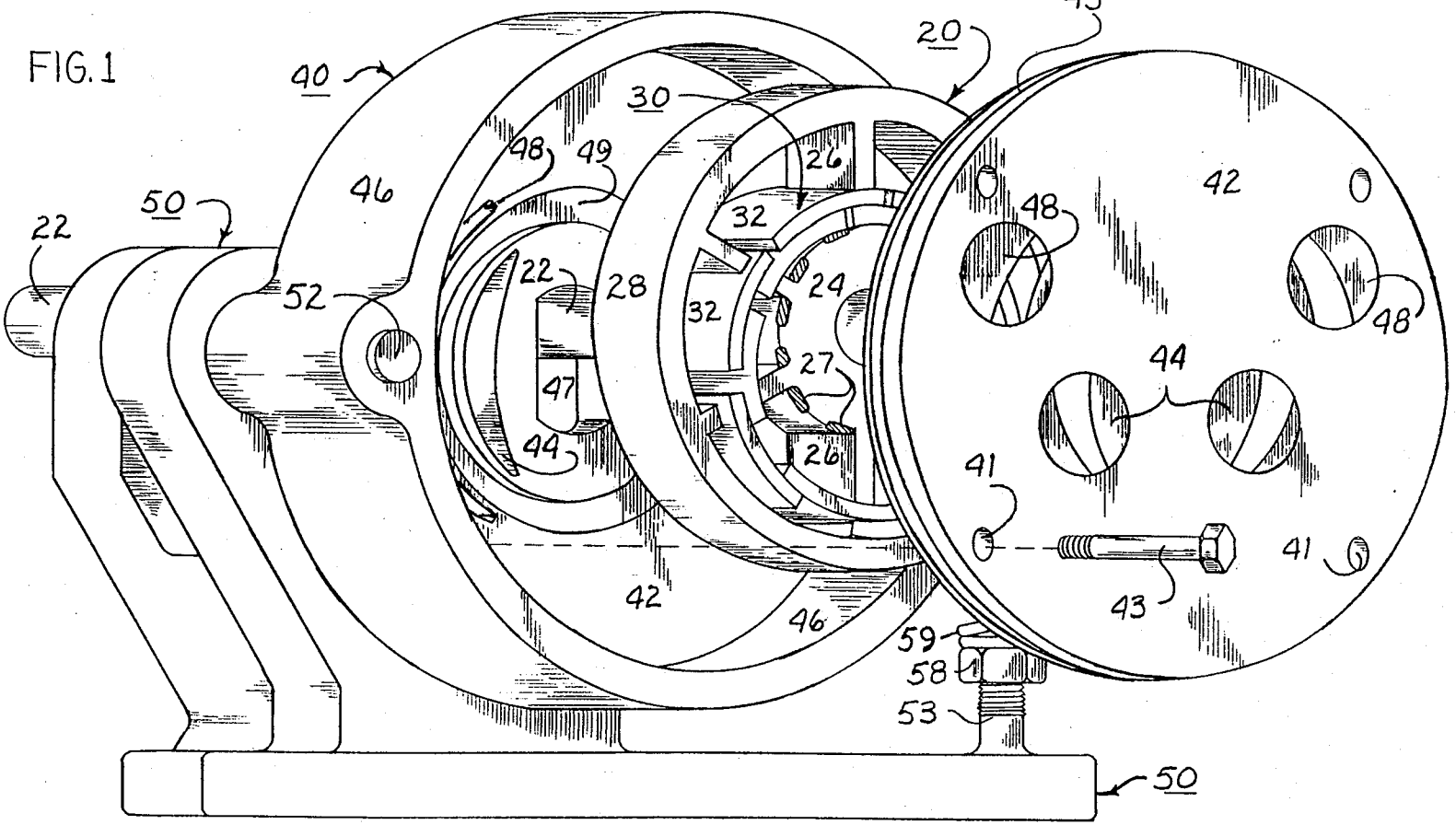
FIG. 1 is an comprehensive, exploded view of an adjustable, reversible embodiment of the present invention.

FIG. 1, is an essentially complete device illustrating the relationship between the various device components and assemblies. Four main assemblies comprise the device; the main rotor assembly 20, the segments assembly 30, the housing assembly 40, and the mounting and adjustment assembly 50.

Figure 2:
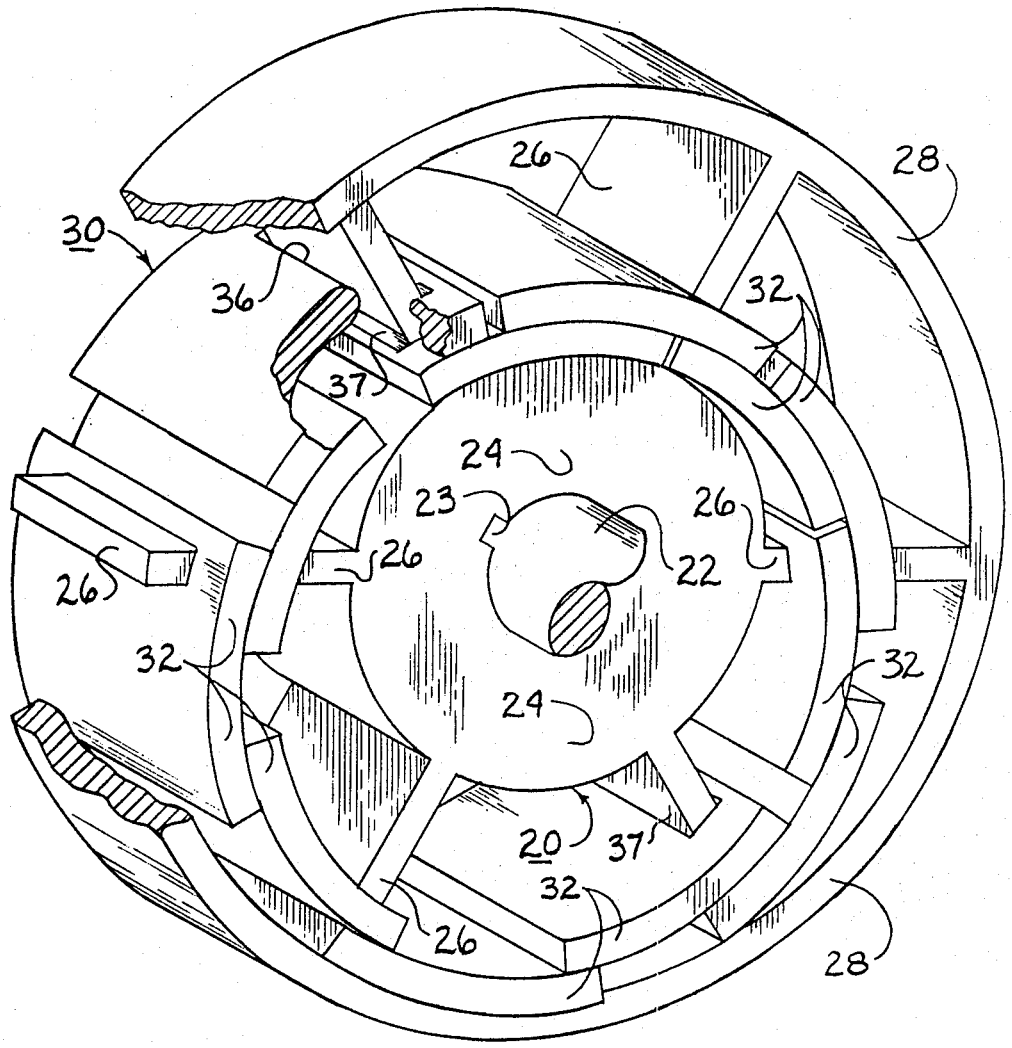
FIG. 2 is an isometric view, partially sectioned, of a rotor and segments assembly. The segments are shown as if supported in a working device.

The rotor assembly 20, more clearly shown in FIG. 2, comprises a a rotor hub 24, rigidly mounting multiple, radial rotor vanes 26, which terminate at, and are affixed to, a concentric rotor containment ring 28. All of the above components share a common co-axial dimension and the rotor described above can be finished as an assembly to insure flat, parallel, rotor ends. The main rotor assembly 20, is rotatably affixed at the center of the rotor hub 24, to a drive shaft 22, by a key 23, or other suitable means.

The segments assembly 30, forms an annulus eccentrically located within the minor diameter of the main rotor containment ring 28, and is comprised of two (or more) relatively thin, concentric, circumferentially incomplete, rings. Each ring comprising ring segments 32, interspaced by segment gaps, or vacant ring spaces. The segment gaps permit the segments 32, which concentrically overlap, to slide past one another to form chords of various lengths as required by eccentric rotation. The segments and segment gaps, alternated in radially adjacent rings, form a barrier to radial movement of the working fluid, dividing the internal volume of the main rotor 20, into two discreet volumes hereafter called work cycles.

The segments 32, have co-axially protruding edges which slideably engage the segments bearings 49, FIG. 1, provided in the internal surfaces of the axial confinement plates 42. Co-rotation of the segments is compelled by the rotor vanes 26, which penetrate each of the segments, usually near one end of the segment by means of a opening which conforms closely to the rotor vane section, permitting the segments to slide freely along the rotor vane length, and compelling the segments 32, to co-rotate as the rotor vanes 26, are angularly relocated.

Because the segments 32, have a calculated rotation axis offset from, and parallel to, the rotation axis of the main rotor 20, the segments pass in close proximity to, or in contact with, the periphery of the rotor hub 24, and diametrically, in close proximity to, or in contact with, the undersurface of the rotor containment ring 28, creating static points, hereafter called cycle pinch-points. Which working fluid co-rotating within the work cycles cannot pass.

The rotation axis offset previously defined, causes the contact angle between the rotor vanes lateral surfaces and the segment penetrations 36, to change as rotation occurs. It is therefore necessary to radius or otherwise relieve the edges of the segment vane penetrations 36, (FIG. 2), which contact the lateral surfaces of the rotor vanes 26. A seal 37, can be located and restrained by the combined reliefs provided by radially adjacent segments penetrated by the same rotor vane. Said seal, formed of suitable material, is activated by inertia, and function augmented by the inter-cycle pressure differential. When the rotor seal 37, completely encircles the rotor vane 26, (not shown) the segment penetrations 36, are also relieved fore and aft the rotor vanes 26, to support and locate said seal, and the longitudinal corners of said vanes can be slightly rounded. In many service applications, the seal 37, need only extend the width of the lateral vane surfaces as indicated in FIG. 2, as the close proximity of the confinement plates 42, can substantially prevent intercycle leakage fore and aft of the rotor vane.

Returning to FIG. 1, the housing assembly 40, is basically comprised of opposed axial confinement plates 42, which rotatably support and locate the segments assembly 30, by providing the matching segments bearings 49 which slideably engage the co-axially protruding edges of the individual segments 32, as previously described, sandwiching the main rotor 20, and the segments assembly 30 closely between. The proximity of the confinement plates 42, to the main rotor assembly 20, is regulated and maintained by co-axially oriented threaded tie bolts 43, using matching tie bolt openings 41, provided in each of said confinement plates.

The confinement plates 42, are circular and of a size to allow a close fit within the bore of the barrel 46, which serves to aline and support the plates. A seal groove 45, can be provided as shown, as it is often convenient to use the volume external to the rotor containment ring 28, and within the bore of the barrel 46, as a working fluid manifold or for housekeeping purposes. It is noteworthy that this method of supporting the confinement plates permits some self-alinement of the plates 42, relative to one another and to the rotor assembly ends 20.

The proximity of the confinement plates 42, to the rotor assembly 20, is adjustable within the limits imposed by the axial clearance of the segments assembly 30, and the segments bearing 49. While this adjustment may be only a few thousandths of an inch, it permits the confinement plates to be positioned for minimum rotor drag at maximum device efficiency for a given working fluid or lubricant viscosity and greatly reduces the number of very close tolerance production machine operations. For example: The barrel 46, need not be of an exact length which is based on the length of the rotor assembly 20, plus a calculated or empirically discovered optimum clearance for a given working fluid, nor does the hinge 54, need be exactly parallel to the rotor assembly axis in the variable displacement embodiments. Production costs are further reduced by being able to use rotor bearings 21, with more radial play than is normally permitted in devices of this type.

This adjustment is performed by the tie bolts 43, usually while the device is in operation. The tie bolts 43, are initially set to permit free rotation of the rotor assembly 20, between the confinement plates 42, which are free to slide axially within the bore of barrel 46. The tie bolts 43, are then tightened or backed off in a predetermined order until minimum rotor drag and maximum device efficiency is achieved.

A working fluid or lubricant film normally present on all internal device surfaces causes the confinement plates 42, which are able to slide relatively freely within the barrel 46, to position themselves equidistant from the rotor assembly while avoiding actual contact of these parts. In embodiments using splines, (not shown), the relatively free movement of the rotor assembly 20, on the drive shaft 22, permits the rotor assembly to center itself between the confinement plates 42, thereby requiring that only one of said confinement plates be adjustable in the manner described above. As noted elsewhere in this specification, an embodiment of this type is especially useful for process pumps used in the food industry as the joint between one of the confinement plates and the barrel can be eliminated by manufacturing these two components as one piece. This eliminates complete disassembly of the pump as no joint exists at this point to trap and breed bacteria.

Figure 5:
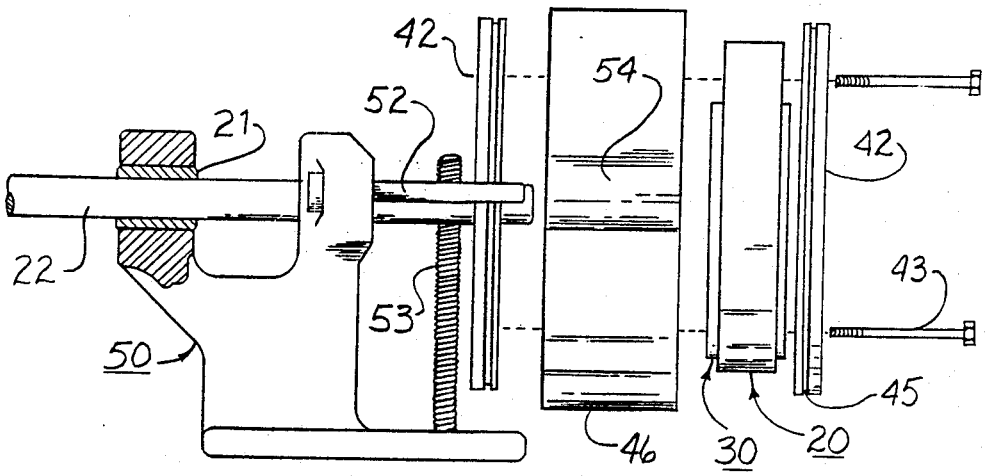
FIG. 5 shows a side view of a partially sectioned cantilevered foot mount and adjustment assembly. The adjustable embodiment of FIGS. 3 and 4, is shown in exploded view.

Openings are provided in one or both axial confinement plates 42, allowing the protrusion of the rotor drive shaft 22. In FIG. 5, the cantilever type rotor drive shaft support 50, requires only the rear confinement plate to be so accessed. The cantilever mount shown is especially convenient for process pumps such as those used in the food industry, as the working fluid connections can be made to the rear confinement plate, and if splines (not shown) instead of a key 22, are used, disassembly for cleaning or maintenance is accomplished by removing the tie bolts 43, the front confinement plate 42, and slipping the rotor assembly 20, complete with segments 30, from the drive shaft.

The mounting and adjustment assembly 50, can be essentially one piece as shown in FIG. 5. The main rotor drive shaft bearings 21, the housing assembly hinge pin 52, and adjustment post 53, are all located and supported by this assembly. The flat base shown in FIGS. 1 and 5, serves as a foot mount.

Figure 3:
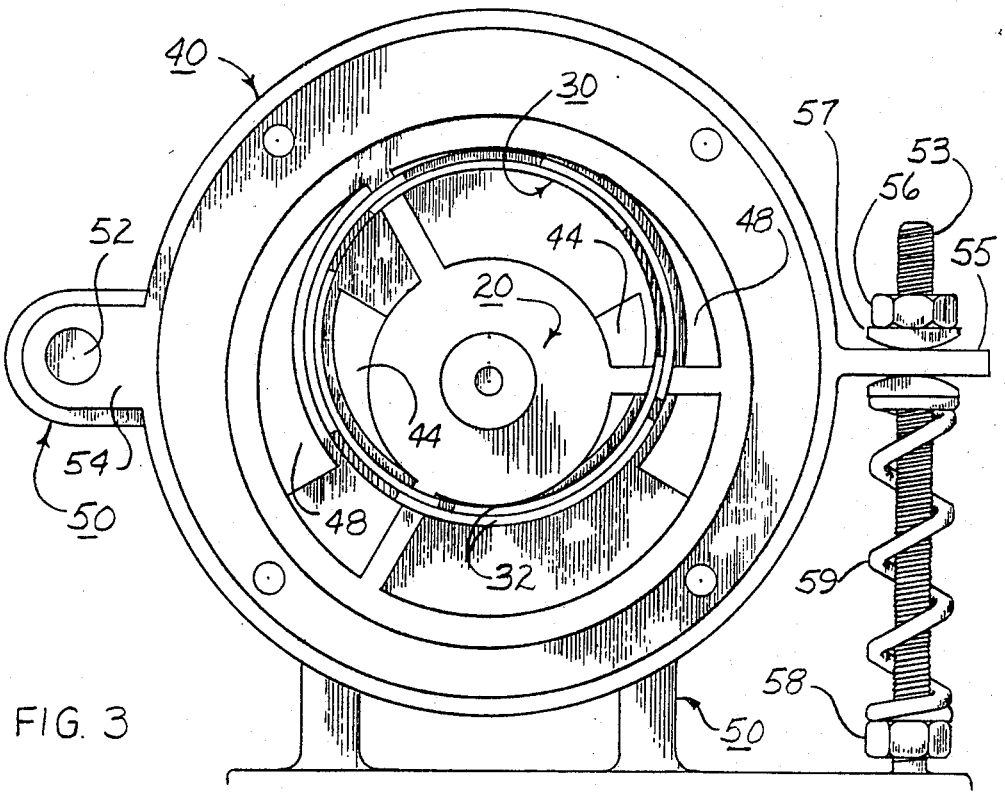
FIG. 3 shows an externally adjustable working fluid volume and pressure pump or variable torque fluid motor embodiment of the present invention. The front confinement plate is removed and the embodiment is adjusted for maximum working fluid output or torque.
Figure 4:
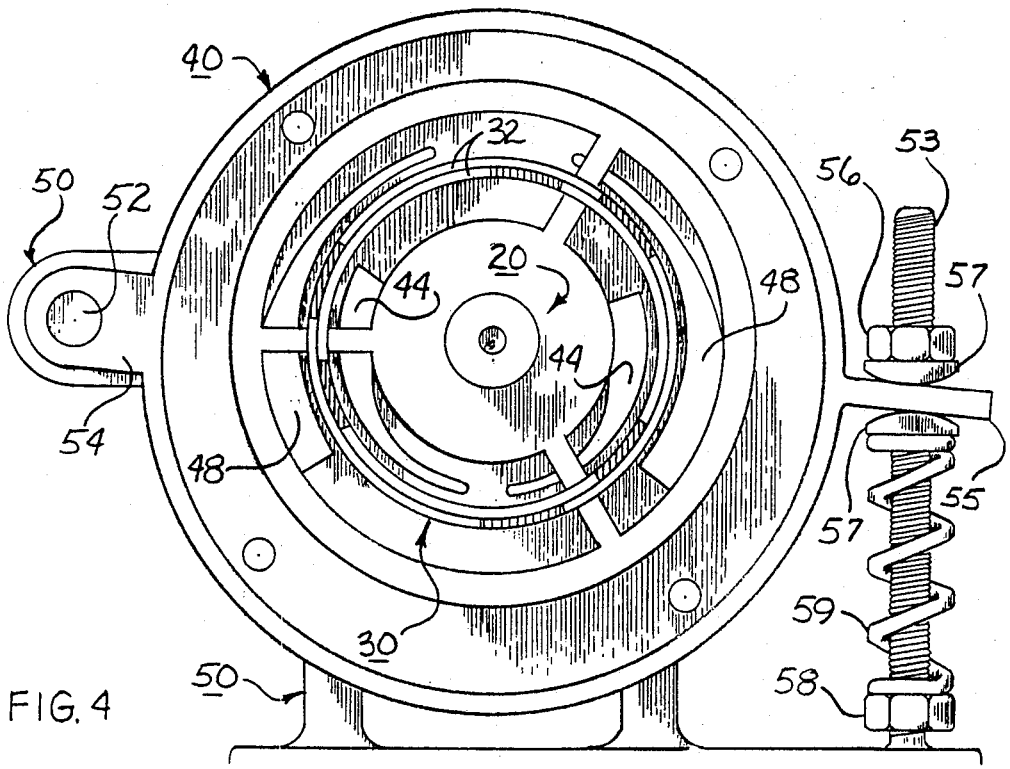
FIG. 4 shows the embodiment of FIG. 3, adjusted for minimum, or zero working fluid output or torque.

The barrel 46, is provided with a hinge 54, and generally diametric a slotted tang 55. A hinge pin 52 and an adjustment post 53, are mounted by the mounting assembly 50. The assembled hinge permits the housing assembly 40, to be relocated along an imaginary line passing through the segments and main rotor rotation axis. A threaded stop nut 56, controls the upward movement of the housing assembly while a second stop nut 58, and spring 59, control downward movement of the housing assembly 40. It should be noted that movement of the housing, by physical connection, must also relocate the segments assembly 30, relative to the main rotor assembly which is independently supported by the rotor drive shaft bearings 21, installed in the mounting and adjustment assembly 50. FIGS. 3 and 4, illustrate this movement.

SLIDING SEGMENT ADJUSTABLE PUMP OR FLUID MOTOR—OPERATION

As previously defined, the segments assembly 30, divides the internal volume within the rotor assembly 20, into two, essentially discreet volumes called the inner and outer work cycles. The rotor vanes 26, further divide the inner and outer work cycle volumes into essentially sealed cycle chambers. The number of chambers in each cycle correspond to the number of rotor vanes employed. The close proximity of the confinement plates 42, to the main rotor assembly 20, substantially control leakage and intracyle movement of the working fluid. The segments 32, the undersurface of the containment ring 28, and the periphery of the rotor hub 24, preventing radial or intercycle fluid movement.

The pinch-point in each work cycle, both fully closed in FIG. 3, separates the inducting work cycle chambers or sub-chambers from those chambers or sub-chambers expelling working fluid. 180 degrees from the work cycle pinch-point, at least one of the rotor vanes 26, seperates the inducting and exhausting cycle chambers. In practice this requires that, diametric the work cycle pinch-point, the working fluid inlet and outlet ports be separated by the angular dimension of a work cycle chamber.

Each work cycle is provided with at least two working fluid ports, one which serves as an inlet, the other the working fluid outlet. The inner cycle ports 44, and the outer cycle ports 48, are located within the one or both confinement plates 42. Although some embodiments can favor a specific rotation direction, rotation is bi-directional. The function of a specific port is therefore dependent on the direction of rotation and the physical location and size of the port access to the work cycle.

In all embodiments of the invention, displacement of the working fluid by the work cycles is the result of cyclic expansion and reduction of the internal volume of the individual work cycle chambers. The outer cycle chambers are defined by undersurface of the containment ring 28, the outer surface of the segments 32, and that portion of the rotor vanes which protrudes beyond the segments assembly 30. The inner cycle chambers are defined by the peripherial surface of the rotor hub 22, the undersurface of the segments 32, and that portion of the rotor vanes between the rotor hub and the undersurface of the segments assembly 30.

Cycle chamber volume expansion or reduction is caused by angularly relocating the chamber(s) relative to the static radial location of the eccentrically disposed segments assembly 30. Angularly relocating the chambers 360 degrees or a complete rotation of the segments and main rotor assemblies 30 and 20 respectively, causes each chamber of each work cycle to progressively effect the minimum and maximum chamber volume possible within that work cycle as determined by the eccentric offset.

The size and location of the working fluid ports is determined by the angular separation of adjacent rotor vanes, the nature of the working fluid, and the intended service. In most embodiments, expanding chambers access a working fluid port or ports, throughout the expansion phase; said port(s) obviously serving as the cycle inlet. The outlet or discharge port(s) normally accesses all cycle chambers being reduced in volume. Immediate access to the outlet by chambers being reduced in volume being especially important if the working fluid is incompressible.

Throughout this discussion of adjustable sliding segment embodiments, it should be recalled that internal sealing is primarily a result of the close proximity of the confinement plates plane internal surfaces to the flat, parallel, rotor end surfaces previously described. In addition, the fact that the segments can slide to form various chords as well as slide along the rotor vane length makes the adjustable embodiment possible.

In adjustable embodiments the offset, or radial distance between the rotation axes of the segments 32, and main rotor assembly 20, can be adjusted by relocating the housing assembly 40, including the segments assembly 30, perpendicular to the rotation axes. In FIG. 3, the maximum offset is shown. As the drawing indicates, contact between the segments and the rotor hub and/or containment ring is acceptable (The velocity of the contacting surfaces is very similar). It is apparent that very little of the working fluid co-rotating within the work cycle chambers can escape across the pinch-point of the cycle and backflow is prevented by the rotor vane trailing the compressing chamber. As a result, the working fluid must exit the cycle via the discharge port provided. The cycle chamber rotationally expanding beyond the cycle pinch-point has a negative or below atmospheric internal pressure and will induct working fluid from a source having atmospheric or higher pressures. When the work cycle inlet pressure exceeds the outlet pressure, the work cycle operates as a fluid motor.

In FIG. 4, the housing assembly 40, has been perpendicularly relocated to the point that the rotation axes are no longer offset. The work cycle pinch-points are no longer defined and the segments rotate concentrically. Working fluid within the work cycles simply co-rotates and the drive idles. If operating as a motor the working fluid "short-circuts", flowing directly from the inlet to outlet ports and no rotational torque is generated.

If the embodiment is operated as a pump and the axes offset is maintained between maximum and minimum, a gap or working fluid path is provided across the work cycle pinch-points, permitting some volume of the working fluid to flow directly from the discharging to the inducting sub-chambers within the work cycle rather than exiting the cycle via the outlet port. This "carry-over" displaces fresh working fluid which would otherwise be inducted, reducing the inlet flow volume. The axes offset distance is also shortened, decreasing the cycle chamber variation between maximum and minimum volumes. These factors substantially determine the working fluid volume actually discharged from the work cycle at a given outlet pressure and rotational speed. It is therefore apparent that increasing or opening the pinch-point gaps decreases the working fluid displacement, while closing the pinch-point gaps increases displacement.

Torque is directly proportional to the offset of the rotation axes. If the embodiment is operated as fluid motor and the cycle pinch-points are gapped, or opened as described above, the effective torque arm is shortened, reducing output torque. In addition, some volume of working fluid can carry over, passing directly out the cycle discharge. It is therefore possible to closely regulate the output torque.

Adjustment or gapping of the pinch-points is accomplished by relocating the entire housing assembly 40, previously noted. A slotted tang 55, affixed to the barrel 46, is located between two threaded stop nuts 56, and 58, a spring 59, and two convex washers 57. Generally opposite the tang 55, a hinge 54, is also affixed to the barrel 46, which has an internal bore permitting the close fit of a hinge pin 52, affixed to the mounting and adjustment assembly 50. The assembled hinge allows the housing assembly 40, to move perpendicular to the rotation axes thereby relocating the segments assembly 30 within the diameter of the main rotor assembly 20.

One of the adjustment stop nuts 56, limits upward movement of the housing assembly 40, while downward movement is restrained by the spring 59, which can be preloaded as desired by adjustment of the second adjustment nut 58. The convex washers 57, compensate for the changing angle of the slotted tang 55 to the threaded adjustment post 53, which, like the hinge pin 52, is also affixed to the mounting and adjustment assembly 50.

Relocating the upper or volume adjustment nut 56, can open or close the cycle pinch-point gaps as desired, thereby regulating the working fluid displacement. Relocation of the lower or pressure adjustment nut 58, preloads the spring 59, thereby regulating the maximum cycle chamber pressures. The spring 59, permits the housing assembly 40, to move in response to an abnormal rise in internal cycle pressures by opening the work cycle pinch-points and permitting a larger volume of the working fluid to carry over.

It is therefore apparent that the rotor shaft output torque, the working fluid displacement volume, and the maximum cycle pressures can be closely regulated by means of the above adjustments. Pumps, compressors, and fluid motors for many applications, using constructions consistent with this embodiment, seldom require external, and usually expensive, valving of any type.

Figure 6:
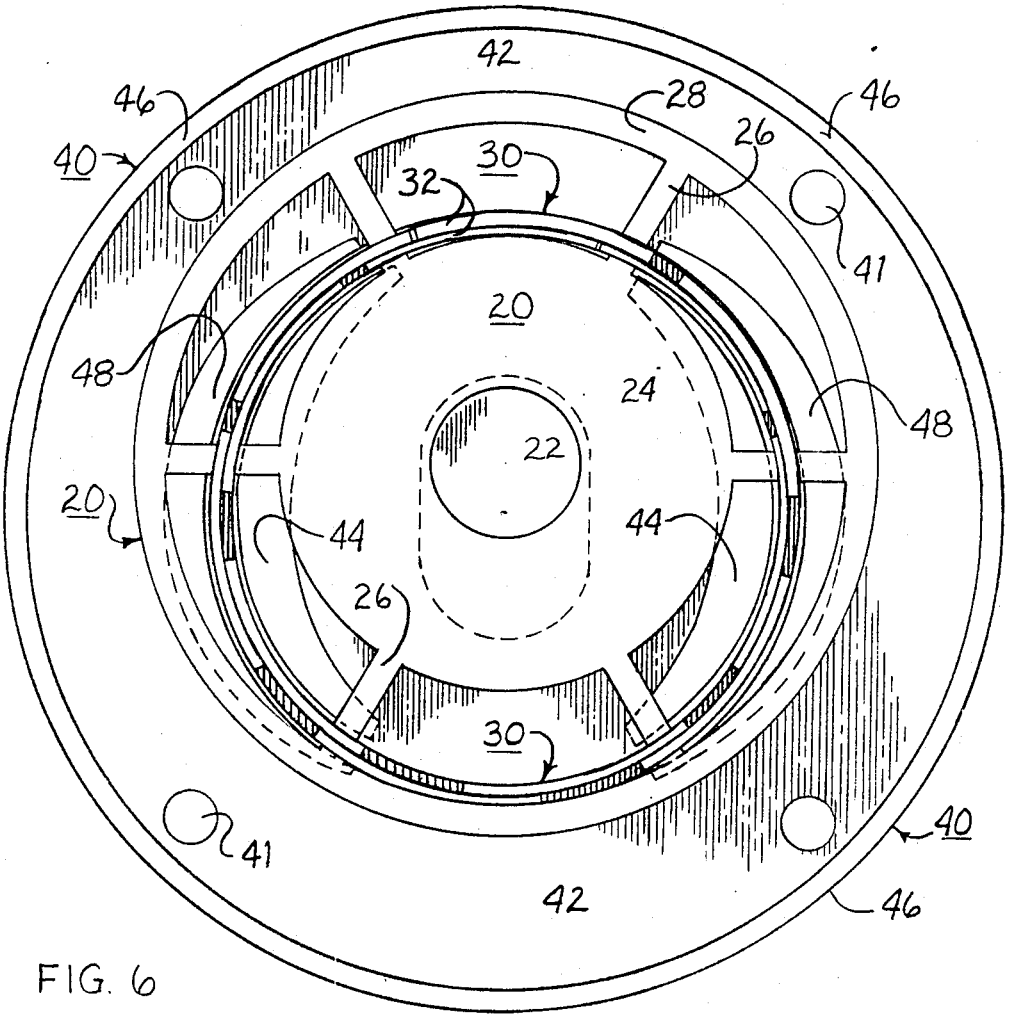
FIG. 6 shows a front view of an adjustable, reversible flow or reversible rotation embodiment, with the front cover removed.

FIG. 6, shows a variable displacement device in which the housing assembly 40, regulated movement described above, is logically extended by modifying the angular length and shape of the cycle ports 44 and 48, providing additional adjustment clearance within the housing barrel 46, and of the drive shaft openings 47, provided by the confinement plate or plates 42. It is possible for this embodiment, not only to regulate the pinch-point gaps, but to form new cycle pinch-points, 180 degrees from the former cycle pinch-point locations.

If the embodiment is operated as a pump; diametric relocation of the cycle pinch-points as described, reverses the cycle port functions; cycle inlets become outlets and vice versa, while the direction of rotation has not been stopped or reversed. The direction of the working fluid flow is reversed by creation of the new, diametrically located cycle pinch-points.

If operated as fluid motor, extreme relocation of the housing 40, relative the rotor axis described above, causes the rotor assembly 20, the reverse rotation.

It makes relatively little difference if the working fluid is compressible or incompressible, or if the device is operated as a pump, compressor, or fluid motor. As a practical matter however, and as those skilled in the art will recognize, it is prudent to ensure that the segments 32, and segments bearings 49, (essentially the only friction source), are of appropriate materials and suitable provision made for handling adiabatic heat. It is noteworthy that if a light oil or similar lubricant is directly injected for this purpose, the volume of lubricant required is generally significantly less than that required by similar, perhaps more familiar constructions, as the present invention is less prone to wipe and expell the lubricant during operation.

Figure 7:
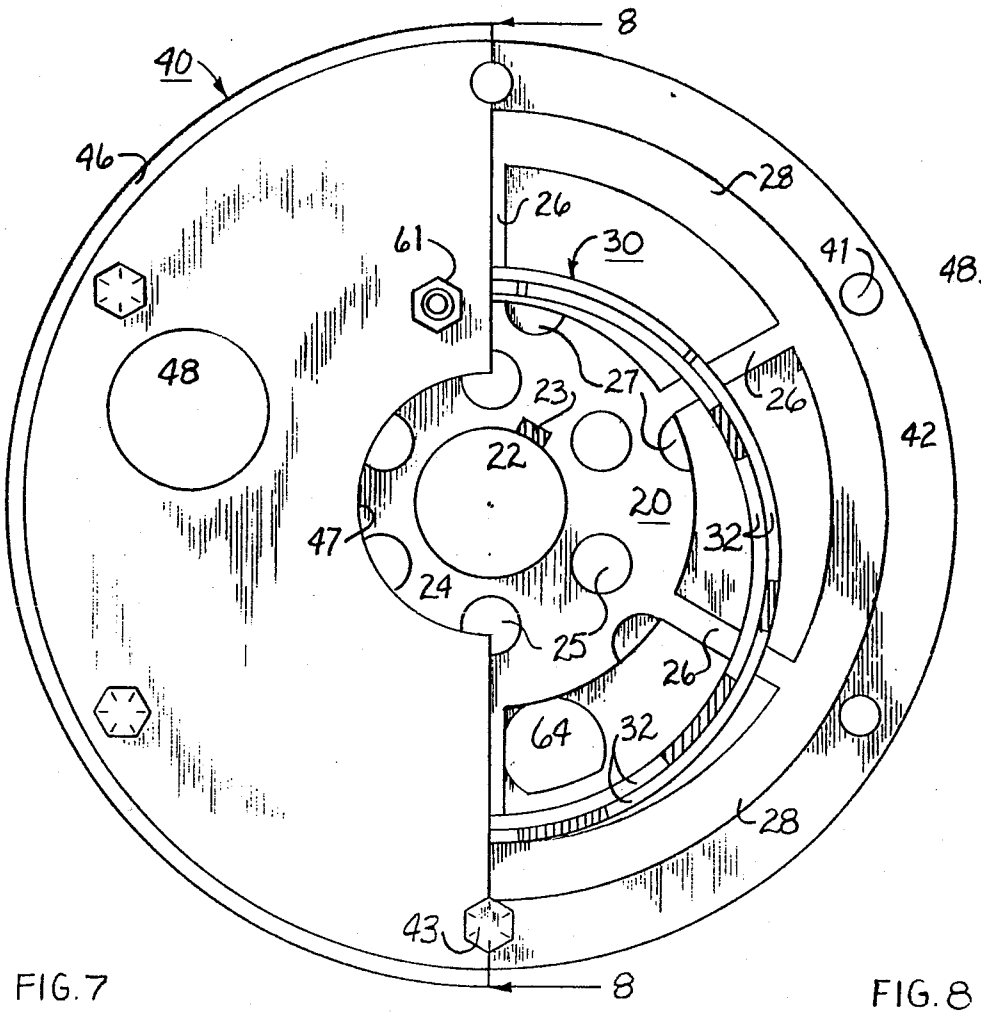
FIG. 7 shows a front view of an internal combustion engine embodiment, with the front confinement plate and barrel sectioned along line 8—8.

The bevels or reliefs 27, provide extended access to working fluid ports, especially outlets if the working fluid is incompressible, or permit a small amount of the working fluid, which might otherwise be trapped, to circumvent the pinch-point by flowing between the confinement plate(s) 42, and main rotor hub 24, as said relief(s) rotationally pass the pinch-point. In FIG. 7, the reliefs 27, are used to provide greater access to the fuel injection means 61, and can be used as a means to valve the injector if desired.

Theoretical torque, either input or output, of any embodiments of the present invention can be calculated by multipling the unbalanced pressure area of the cycle chamber vane or vanes leading rotation (rotation axes offset), times the rotor axial length (rotor vane width), times the rotor vane effective length (mean segments bearing radius), times the mean cycle pressure (cycle inlet pressure minus cycle outlet pressure divided by two), adding the totals for each working cycle within the device. The work cycles are assumed to be 100% efficient and the cycle pinch-points fully closed.

Displacement per revolution is the internal volume of the rotor using the minor radius of the containment ring, and subtracting the combined volume of the internal components.

Calculating the volume of either work cycle will equal the displacement of the cycle if special attention is paid to the segment gaps. Outer cycle segment gaps open, (segment overlap is minimal at the outer cycle pinch-point). It is therefore necessary to calculate the maximum segment gap volume, times the number of segment gaps in the cycle, and subtract this figure from the calculated total displacement of the outer cycle.

In calculating inner cycle displacement, the segment gaps close during chamber compression, thereby also displacing working fluid. The total cycle displacement is obtained by calculating the maxiumum segment gap volume, times the number of gaps in the cycle, and adding this figure to the calculated total displacement of the cycle. (At maximum segment overlap, the segment gap volume of a given segment ring is assumed to be zero.)

This characteristic of the present invention greatly facilitates supercharging or staging the work cycles, as the actual displacement of the inner and outer cycles is similar and can be adjusted to some extent by employing inner and outermost segments of various thicknesses, and by providing essentially superficial reliefs 27, FIG. 1 and 7, which permit a calculated volume of working fluid to be carried through the cycle pinch-point, thereby altering the actual volume of working fluid displaced by the cycle.

While the adjustable and reversible embodiments defined above are extremely useful in themselves, those skilled in the art will recognize that relatively simple, low cost combinations of the various embodiments already described can provide a third catagory of devices such as clutches, rotary power transmissions, brakes, and many other similar devices, which can be operated, without external valves, by relatively simple low cost controls and conventional drive and driven devices.

INTERNAL COMBUSTION ENGINE—DESCRIPTION

Figure 8:
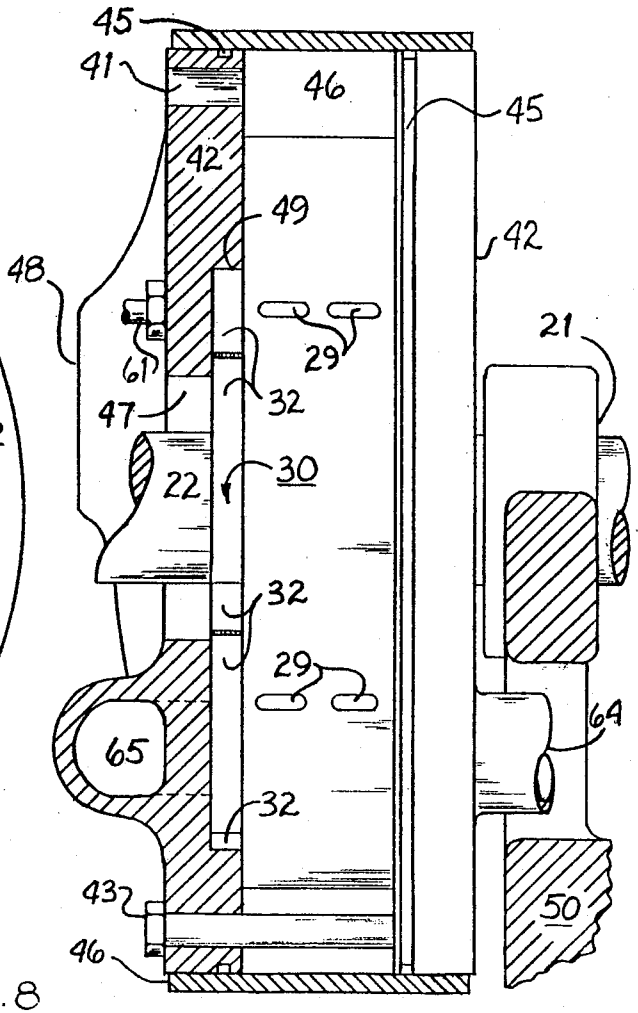
FIG. 8 is a side view with the mounting assembly partially shown and partially sectioned, and the front cover and barrel sectioned along line 8—8 of FIG. 7.

FIG. 7 and 8, show an internal combustion engine embodiment of the invention. This embodiment is obviously quite similar to embodiments previously described. Exceptions being the inner cycle porting 44; at least one of which serves as a combustion exhaust and another as a charging air inlet, being located closely approximate, both substantially diametric to the cycle pinch-point rather than immediately adjacent, as in pump and fluid motor embodiments.

A limited and more precise form of the displacement adjustment previously described in regard to pumps and fluid motors, is used primarily to regulate the effective compression ratio of the power cycle.

Another exception being the modified rotor, which is provided with coolant passages. A suitable coolant, usually oil or air, is inducted at the rotor hub 24, via co-axial openings 25, which connect and supply coolant to, radial bores within the rotor vanes 26. The coolant being dynamically displaced from the rotor vanes via openings 29, provided in the rotor containment ring 28. The coolant being then reclaimed within, or expelled from, the adjustment and tie bolt clearance space within the housing assembly 40, external to the containment ring 28.

INTERNAL COMBUSTION ENGINE—OPERATION

Internal combustion operation of the embodiment is similar to two cycle conventional piston engine operation and may be more readily understood in this context.

In the embodiment of FIG. 7, the outer cycle serves to induct and lightly supercharge fresh combustion air. The charging air provided by the outer cycle discharge being ducted by a tunnel or conduit 65, to the inner cycle port leading rotation. The charging air being then highly compressed as the inner cycle chamber or chambers containing the fresh charging air rotationally approach the inner cycle pinch-point.

At a predetermined point, determined largely by the angular location of the fuel injection or ignition device 61, combustion is initiated. As combustion begins and progresses, rotation has relocated the combusting chamber to an angular position at which the rotor vane leading said chamber now has the greater surface area and the chamber internal pressure, enhanced by combustion, promotes continued rotation and a net positive output shaft torque.

As the combusting chamber pressure is expended promoting rotation, the first of the inner cycle ports, the exhaust port 64, located about 160 degrees from the cycle pinch-point is accessed, and the spent combustion gases permitted to escape the cycle chamber. The inner cycle port 65, serving as the cycle inlet, is almost immediately accessed by continued rotation. The fresh, lightly pressurized charge enters the venting chamber by means of said port, scavenging residual exhaust and recharging the chamber with fresh combustion air, and the cycle is repeated.

Combustion timing is accomplished primarily by providing multiple injectors or ignition devices 61, having unique angular locations a few degrees apart.

It should be kept in mind that combustion, and in fact all operational events, are essentially continuous. Ignition and fuel injections can therefore also be continuous.

The pinch-point gap adjustment in combustion engine embodiments can be quite limited and is seldom fully closed in operation. The high velocity of the compressing charge flowing through the pinch-point at the same time as combustion is initiated or in progress, promotes thorough mixing of the fuel and air, and tends to substantially reduce combustion chamber pressure spiking, providing instead, a more gradual combustion pressure increase.

CONCLUSION, RAMIFICATIONS AND SCOPE OF INVENTION

While the above description contains many specificities, the reader should not construe these as limitations on the scope of the invention, but merely as exemplifications of perferred embodiments thereof. Those skilled in the art will envision many other possible variations are within its scope. For example skilled artisans will readily be able to change the dimensions and shape of the various embodiments, while at the some time maintaining critical relationships. Another obvious variation would be to use anti-friction bearings, multiple ports having the same function and serving the same work cycle to reduce pumping work and decrease working fluid intake velocities, and mounting the rotor assembly 20, and confinement plates 42, in the manner of the prior art. They will undoubtedly envision many applications, even functions which, for purposes of comprehension, and relative importance (necessarily subjective), are not specifically included in this application. An example being a flowmeter, or fluid volume measurement device in which the drive shaft 22, need not extend outside the housing 40; rotation being monitored by a inductive pickup mounted on, or in the housing assembly 40, and simple permanent magnet, inset in a convenient location on the rotor assembly 20. It will be obvious to those skilled in the art that the range of combinations afforded by the multiple work cycles, various working fluid port locations, and the various adjustments in considerable. The variety of mechanisms, to include mechanical, pneumatic, hydraulic, and electric, which can be employed to mount, guide, and perform the device adjustments previously defined, is obviously numerous and highly dependent on the application and service environment. They will also recognize that employing two or more of the present invention embodiments in various combinations can provide a third catagory of devices having unique functions not generally readily apparent. For example, combining an adjustable and reversible embodiment as a pump and a second non-adjustable embodiment as a fluid motor, and providing suitable fluid connections between the two results in a clutchable, brakeable, reversible rotary power transmission device capable of torque multiplication, which can be enclosed within a sealed case also serving to contain the working fluid supply. It is also obvious that, to attempt to delineate the embodiments, features, and components which are implied, although not specifically depicted by the description and drawing is not very practical, and would probably only serve to try the patience of the reader. Accordingly the reader is requested to determine the scope of the invention by the appended claims and their legal equivalents, and not by the examples which have been given.

What I claim is:

1. An improved, adjustable, rotary vane device of the type comprising:

a main rotor having a central hub mounting a plurality of fixed vanes and a containment ring being concentrically affised to said fixed vane extremities, rotatably mounted between opposed working fluid confinement plates which provides a segments rotor bearing rotatably supporting a segments rotor comprising overlapping arcuate segments penetrated by said fixed vanes, said segments rotor forming a circular, normally eccentrically disposed working fluid barrier lying substantially within the major diameter of said main rotor and dividing the internal volume of said main rotor into work cycles, said work cycles being further divided into chambers by said fixed vanes; said chambers provided with access to working fluid inlet and outlet ports by rotation of said main rotor;

wherein the improvement comprises; said confinement plates can be repositioned as a tandem assembly relative the axis of said main rotor by a lateral adjustment means comprising a plurality of threaded boltlike members and said main rotor is rotatably supported by a mounting means essentially independent of said confinement plates.

2. The device of claim 1, wherein said lateral adjustment means is provided with an adjustable tension means.

3. The device of claim 2, wherein a segment penetration seal can be located between radially adjacent segments penetrated by the same rotor vane.

4. The device of claim 1, wherein internal coolant passages are provided within said main rotor, inducting coolant at the hub of said main rotor and centrifugally discharging said coolant via openings provided in said containment ring.

5. The device of claim 1, wherein one of said work cycles is provided with combustion air and a fuel admixing and ignition means; said combustion air being provided by the second of said work cycles.

6. The device of claim 5, wherein fuel mixing is substantially performed by the flow of combustion air through the venturi like pinchpoint gap between subchambers of said work cycle used as the power cycle.

7. The device of claim 6, wherein the effective compression ratio of said power cycle is regulated by said lateral adjustment means.

8. The device of claim 7, wherein said ignition means is provided by the heat of compression of said combustion air.

* * * * *